US005377848A

United States Patent [19]

Jokinen et al.

[11] Patent Number: 5,377,848

[45] Date of Patent: Jan. 3, 1995

[54] ROLLER SCREEN FOR SCREENING BULK MATERIAL, ESPECIALLY WOOD CHIPS

[75] Inventors: Mikko Jokinen; Timo Kurki, both of Rauma, Finland

[73] Assignee: Consilium Bulk Babcock Oy, Rauma, Finland

[21] Appl. No.: 117,183

[22] PCT Filed: Feb. 12, 1992

[86] PCT No.: PCT/FI92/00038

§ 371 Date: Sep. 13, 1993

§ 102(e) Date: Sep. 13, 1993

[87] PCT Pub. No.: WO92/16311

PCT Pub. Date: Oct. 1, 1992

[30] Foreign Application Priority Data

Mar. 21, 1991 [FI] Finland ..... 911383

[51] Int. Cl.[6] ..... B07B 13/05

[52] U.S. Cl. ..... 209/673

[58] Field of Search ..... 209/667, 671, 672, 673, 209/674

[56] References Cited

U.S. PATENT DOCUMENTS

| | | | |
|---|---|---|---|
| 1,677,838 | 7/1928 | Molin . | |
| 1,941,147 | 12/1933 | Johlige | 209/104 |
| 2,966,267 | 12/1960 | Dunbar | 209/672 X |
| 3,817,375 | 6/1974 | Herkes | 209/673 |
| 3,870,627 | 3/1975 | Herkes | 209/672 X |
| 4,301,930 | 11/1981 | Smith | 209/672 X |
| 4,658,964 | 4/1987 | Williams | 209/672 X |
| 4,836,388 | 6/1989 | Bielagus | 209/667 X |
| 4,871,073 | 10/1989 | Berry et al. | 209/672 |
| 4,901,864 | 2/1990 | Daugherty | 209/672 |
| 4,903,845 | 2/1990 | Artiano | 209/671 |

FOREIGN PATENT DOCUMENTS

| | | | |
|---|---|---|---|
| 0328067 | 8/1989 | European Pat. Off. | D21B 1/02 |
| 36554 | 5/1935 | Netherlands | 209/672 |

*Primary Examiner*—David H. Bollinger
*Attorney, Agent, or Firm*—Robert R. Jackson

[57] ABSTRACT

The invention relates to an apparatus for separating finer and coarser material fractions of bulk material from each other, especially for separating sawdust from wood chips, the apparatus comprising a plurality of successive rollers (2) rotating about parallel axes of rotation, the upper surfaces of the rollers providing a path for the material to be screened; and a hopper for feeding the material to be screened to the infeed end of the path. There are radial and essentially axial grooves (5, 6) on the surface of the rollers (2), the grooves forming teeth (7) onto the surface of the rollers (2), and the teeth (7) of each roller (2) interdigitate with the radial grooves (5) of the adjacent roller (2), whereby the teeth (7) and radial grooves (5) form slots (8) between them for the particles of the material to be screened. With this construction it is possible to prevent the particles that are bigger than the grain size desired from passing through the screen.

4 Claims, 1 Drawing Sheet

ROLLER SCREEN FOR SCREENING BULK MATERIAL, ESPECIALLY WOOD CHIPS

Figure 3:
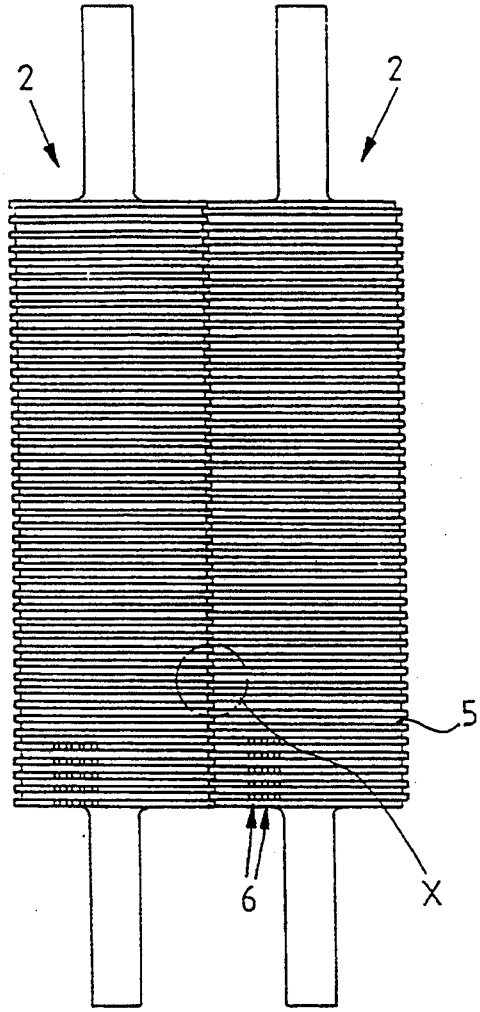

The invention relates to a roller screen for separating finer and coarser material fractions of bulk material from each other, especially for separating sawdust from wood chips, the roller screen comprising a plurality of successive rollers rotating about parallel axes of rotation, the upper surfaces of the rollers providing a path for the material to be screened; at least one drive means for rotating the rollers; and a means for feeding the material to be screened to the infeed end of said path. The roller screen according to the invention can be used e.g. in the production of cellulose for screening wood chips used as process feed.

Known apparatuses for screening bulk material include disc screens and various roller screens. A disc screen consists of successive shafts to which discs are attached at regular intervals in such a manner that the discs on successive shafts interdigitate. The shafts rotate at the same rate and to the same direction. The upper surface of the discs functions as a conveyor of the material to be screened and between the discs there is a gap determined by the grain size desired, the finer fraction falling through the screen at the gap while the coarser fraction on passes on to the discharge end of the screen. Previously known disc screens are described e.g. in Finnish Patent Application 780,685 and Finnish Published Specification 70,379.

A roller screen comprises rotating rollers instead of disc shafts. Between the rollers is a gap determined by the grain size desired, the finer material fraction falling through the screen at the gap while the coarser fraction passes on to the discharge end of the screen on the upper surface of the rollers.

Drawbacks of disc screens are a great demand of power and heavy wear of discs, which are due to the large contact surface of the discs and the material to be screened. A disc screen is ill-suited for separation of particulate sawdust of a grain size of less than 3 to 5 mm from wood chips since the particles falling between the discs may be of any length although their thickness is not greater than the gap between the discs. This results in loss of pulpwood, which is useful e.g. in a process for producing cellulose, together with the sawdust removed from wood chips.

The same drawback is also found in known roller screens since the particles falling through the gap between the rollers may be of considerable length in the axial direction of the rollers although their thickness is not greater than the gap.

The object of the present invention is to remedy the above drawbacks by improving the construction of the known roller screen. This is achieved with the roller screen according to the invention, which is characterized in that there are radial and essentially axial grooves on the surface of the rollers, the grooves forming teeth onto the surface of the rollers, and that the teeth of each roller interdigitate with the radial grooves of the adjacent roller, whereby the teeth and radial grooves form slots between them for the particles of the material to be screened.

The invention is based on the idea that the surface of the rollers is grooved in such a manner that slots of the grain size desired are formed between the rollers, the slots "closing" momentarily when the rollers rotate in such a manner that the particles of the wrong size do not pass through the screen.

Thus, in the roller screen of the invention only the particles that are of the grain size selected or smaller than that pass through the screen at the slots that are precisely of the grain size selected. Elongated particles that are bigger than the grain size desired cannot pass through the screen. This is the most significant advantage of the roller screen of the invention in regard to the known apparatuses. In addition, the power demand of this roller screen is smaller and the wear of the screening means is not as heavy as in a disc screen since the contact surface between the screening means and the material to be screened is small. Furthermore, the construction of the roller screen is simple and the production costs are reasonable.

Figure 1:
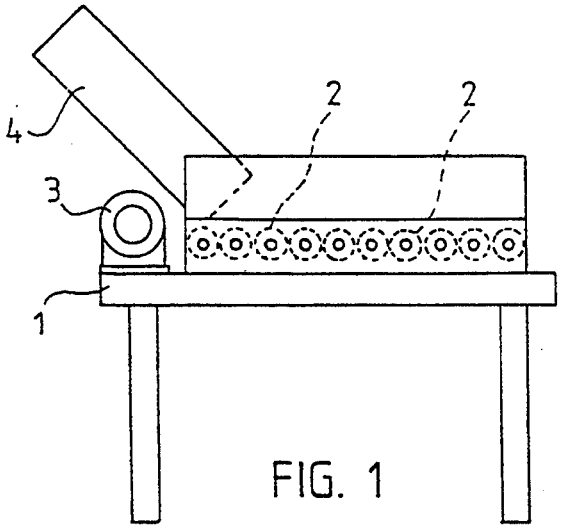
Figure 2:
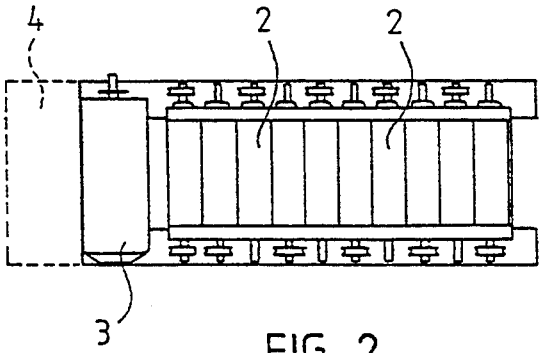
Figure 4:
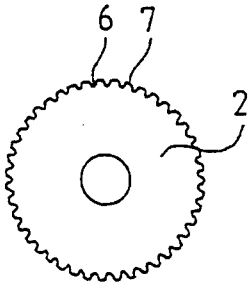
Figure 5:
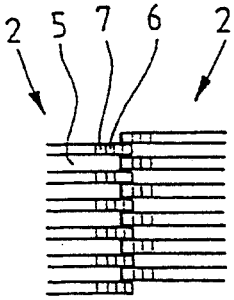
Figure 6:
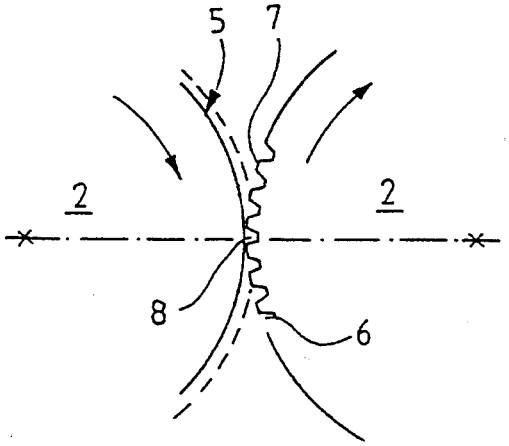

In the following the invention will be described in greater detail by means of an advantageous embodiment by way of example with reference to the attached drawings wherein FIG. 1 shows a side view of the roller screen according to the invention, FIG. 2 shows a top view of the roller screen according to the invention, FIG. 3 shows a top view of interdigitation of two screening rollers that are used in the roller screen of the above Figures, FIG. 4 shows the screening roller of FIG. 3 in the axial direction, FIG. 5 shows a magnified view of the point X of FIG. 3, and FIG. 6 shows formation of particle slots between two adjacent screening rollers.

The roller screen according to FIGS. 1 and 2 comprises a framework 1, screening rollers 2 for the material to be screened, a drive means 3 for driving the screening rollers 2 and a hopper 4 for feeding the material to be screened onto the rollers 2.

The rollers 2 are mounted side-by-side in the horizontal direction on the upper part of the framework 1 in such a manner that they rotate about parallel axes of rotation. The upper surfaces of the rollers 2 provide a path for the material to be screened, and the material to be screened is to be fed from the hopper 4 to the infeed end of said path.

As shown in FIGS. 3 to 6, there are radial and axial grooves 5 and 6 on the surface of the rollers 2, the grooves forming teeth 7 onto the surface of the rollers. The teeth 7 of each roller 2 interdigitate with the radial grooves 5 of the adjacent roller 2, whereby the teeth 7 and the radial grooves 5 form slots 8 between them for the particles of the material to be screened.

The clearance between the teeth 7 and the grooves 5 and 6 is as small as possible, i.e. of the size that the rollers 2 can rotate without touching one another. All the rollers 2 rotate to the same direction. Most appropriately the radial grooves 5 and axial grooves 6 in the same roller 2 are equal in depth.

The bulk material to be screened is dropped onto the arrangement of rollers at the infeed end of the apparatus. The rotating rollers 2 convey the material forward on the upper surface thereof toward the discharge end of the apparatus. The small particles fitting into the tooth clearances of the rollers 2 pass on to the bottom side of the rollers, i.e. through the apparatus, at the slots 8 formed by the tooth clearances and the grooves 5 and 6 of the adjacent roller. The particles that are bigger than the grain size desired are conveyed on top of the rollers 2 to the discharge end of the apparatus. When the rollers 2 rotate, all the slots 8 momentarily "close" each in turn, wherefore only a particle fitting into said slots can pass through the screen.

The invention has been described above only by means of one advantageous embodiment, describing a roller screen that is particularly well suited for screening of wood chips. All the slots 8 can be of the same size. Said roller screen can naturally also be used for screening other bulk material and for sorting it in accordance with the grain size, whereby the size of the slots can increase toward the discharge end of the arrangement of rollers. It is also possible for one skilled in the art to carry out other details of the invention in various ways without deviating from the scope of the invention defined by the claims.

We claim:

1. A roller screen for separating finer and coarser material fractions of bulk material from each other, especially for separating sawdust from wood chips, the roller screen comprising a plurality of successive rollers rotating about parallel axes of rotation, the upper surfaces of the rollers providing a path for the material to be screened; at least one drive means for rotating the rollers; and a means for feeding the material to be screened to the infeed end of said path, wherein there are radial and essentially axial grooves on the surface of the rollers, the grooves forming teeth onto the surface of the rollers, and that the teeth of each roller interdigitate with the radial grooves of the adjacent roller, whereby a pocket is formed between each circumferentially adjacent pair of teeth on each roller and the radial groove of the adjacent roller in which said pair of teeth is interdigitated, the axial clearance between each said pair of teeth and each side of the groove in which said pair of teeth is interdigitated being less than the circumferential distance between said pair of teeth, only said finer particles being able to pass through said roller screen via said pockets.

2. A roller screen according to claim 1, wherein the radial grooves and axial grooves in the same roller are essentially equal in depth.

3. A roller screen according to claim 2, wherein the clearance between the teeth and the grooves is as small as possible, which enables the rollers to rotate without touching one another.

4. A roller screen according to claim 1, wherein the clearance between the teeth and the grooves is as small as possible, which enables the rollers to rotate without touching one another.

* * * * *